US008776378B2

(12) United States Patent
Tomassetti et al.

(10) Patent No.: US 8,776,378 B2
(45) Date of Patent: Jul. 15, 2014

(54) RAZOR WITH BLADE HEATING SYSTEM

(75) Inventors: Louis D. Tomassetti, Pompano Beach, FL (US); William Bohmer, Randolph, NJ (US)

(73) Assignees: L.P.I. Consumer Products, Inc., Pompano Beach, FL (US); Display Matrix Corporation, Randolph, NJ (US)

( * ) Notice: Subject to any disclaimer, the term of this patent is extended or adjusted under 35 U.S.C. 154(b) by 0 days.

(21) Appl. No.: 13/417,936

(22) Filed: Mar. 12, 2012

(65) Prior Publication Data

US 2012/0222310 A1 Sep. 6, 2012

Related U.S. Application Data

(62) Division of application No. 12/082,840, filed on Apr. 15, 2008, now abandoned.

(51) Int. Cl.
*B26B 21/48* (2006.01)
*B26B 21/22* (2006.01)

(52) U.S. Cl.
USPC ..... 30/34.05; 30/140

(58) Field of Classification Search
CPC ..... B26B 21/48; B26B 21/22; B26B 21/40
USPC ..... 30/34.05, 140, 50
See application file for complete search history.

(56) References Cited

U.S. PATENT DOCUMENTS

| | | | | |
|---|---|---|---|---|
| 5,994,855 | A * | 11/1999 | Lundell et al. | 318/114 |
| 6,065,391 | A * | 5/2000 | Archard et al. | 99/342 |
| 6,817,101 | B1 * | 11/2004 | Bohmer | 30/34.05 |
| 6,836,966 | B2 * | 1/2005 | Patrick | 30/34.05 |
| 7,353,606 | B2 * | 4/2008 | Hudgins | 30/30 |
| 8,533,958 | B2 * | 9/2013 | Tomassetti et al. | 30/34.05 |
| 8,661,687 | B2 * | 3/2014 | Rebaudieres et al. | 30/34.05 |
| 2005/0188540 | A1 * | 9/2005 | Kelly et al. | 30/45 |
| 2006/0037197 | A1 * | 2/2006 | Hawes et al. | 30/45 |
| 2006/0076341 | A1 * | 4/2006 | Lozinski et al. | 219/248 |
| 2009/0056141 | A1 * | 3/2009 | Barry et al. | 30/41.7 |
| 2009/0255123 | A1 * | 10/2009 | Tomassetti et al. | 30/34.05 |
| 2012/0222310 | A1 * | 9/2012 | Tomassetti et al. | 30/34.05 |
| 2012/0227265 | A1 * | 9/2012 | Tomassetti et al. | 30/34.05 |

* cited by examiner

*Primary Examiner* — Hwei C Payer
(74) *Attorney, Agent, or Firm* — Robert M. Downey, P.A.

(57) ABSTRACT

In a razor having a handle and a blade cartridge containing one or more blades, a system is provided for selectively heating the blades to a controlled temperature range. The blade heating system includes an electric circuit with a battery power source for controlled direction of current flow through the one or more blades in order to heat the blades. The electric circuit further includes an on/off switch, a visual indicator for indicating on/off status, a heat controller for selectively adjusting the temperature of the blades, and an automatic turn off switch for opening the circuit after an elapsed period or some action or non-action of physical movement of the razor for preserving battery life. In a preferred embodiment, all of the components of the electric circuit are housed on the blade cartridge, with the battery power source, switches and heat controller contained within a waterproof casing.

4 Claims, 6 Drawing Sheets

RAZOR WITH BLADE HEATING SYSTEM

This application is a Divisional Application based on non-provisional patent application Ser. No. 12/082,840 filed on Apr. 15, 2008, now abandoned.

BACKGROUND OF THE INVENTION

1. Field of the Invention

The present invention relates generally to razors for shaving and, more particularly, to a battery powered system in a razor for controlled heating of one or more blades of the razor.

2. Discussion of the Related Art

It is well known that hairs are softened and easier to cut when they are heated just prior to being cut by the sharp cutting edge of a razor blade. It is also known that the cutting edge of the razor blade is more effective in cutting hairs when the blade is warm or hot. Just prior to shaving, most people warm the hairs and skin with hot water or a hot towel. It is also common practice to place the shaver under hot running water in order to heat the blades just prior to stroking the blades over the skin in order to cut the hairs. However, the heat cutting performance of the blades lasts only a short time during the beginning of the shaving stroke. Within seconds, the temperature of the skin surface, hairs and blade are quickly reduced due to exposure to the ambient air temperature. Ideally, it is best to maintain the blades warm or hot throughout the shaving process.

One particular prior art blade heating invention, disclosed in U.S. Pat. No. 6,817,101 B1 to Bohmer, provides a shaving system with a continuously heated blade cartridge throughout the shaving stroke. Heating the blades is attained by applying a measured amount of electric current to the blade cartridge by means of conductors connected to each side of the blade cartridge and extended in the form of contacts at the connection of the blade cartridge to a razor handle. Electric current is provided by a primary battery contained in a waterproof compartment in the razor handle. Current provided by the battery renders optimum heat generation in the blades in the cartridge and can be adjusted by means of resistors in series with the blade and blade cartridge. A momentary contact switch closes the circuit and is operated by the user during the shaving stroke.

The present invention improves upon the shaving system disclosed in U.S. Pat. No. 6,817,101 B1 and provides for a heat controller for allowing the user to selectively adjust the heated temperature of the blades for desired comfort and optimum blade cutting efficiency. The present invention further provides for a visual indictor, such as an LED, to indicate on and off status of the blade heating system. A further improvement provided by the present invention is an automatic turn-off switch, in addition to a user controlled on/off switch, for automatically turning the heating system off after use of the razor in the event the user fails to operate the on/off switch, thereby preserving battery life. A further improvement provides for a total "onboard" heating system in a disposable blade cartridge, thereby providing for controlled heating of blades in disposable blade cartridges for use on conventional razor handles.

SUMMARY OF THE INVENTION

In a razor having a handle and a blade cartridge containing one or more blades, a system is provided for selectively heating the blades to a controlled temperature range. The blade heating system includes an electric circuit with a battery power source for controlled direction of current flow through the one or more blades in order to heat the blades. The electric circuit further includes an on/off switch, a visual indicator for indicating on/off status, a heat controller for selectively adjusting the temperature of the blades, and an automatic turn off switch for opening the circuit after a predetermined period of time has elapsed, or upon some action or non-action of physical movement of the razor, in order to preserve battery life. In a preferred embodiment, all of the components of the electric circuit are housed on the blade cartridge, with the battery power source, switches and heat controller contained within a waterproof casing.

Objects and Advantages of the Invention

Considering the foregoing, it is a primary object of the present invention to provide a blade heating system in a razor that allows for controlled adjustment of the heated temperature of one or more blades in the blade cartridge of the razor.

It is a further object of the present invention to provide a blade heating system in a razor for controlling the heated temperature of one or more blades in the blade cartridge of a razor, and wherein the heated temperature level is visually indicated on a display.

It is still a further object of the present invention to provide a blade heating system for a razor that is contained entirely within a disposable blade cartridge.

It is still a further object of the present invention to provide a heating system in a razor for heating one or more blades in the blade cartridge of the razor and including a visual indicator for indicating an on and off status of the heating system.

It is still a further object of the present invention to provide a heating system in a razor for heating one or more blades in the razor cartridge and including an automatic turn off switch for turning the heating system off after use, thereby preserving battery life.

These and other objects and advantages of the present invention are more readily apparent with reference to the following detailed description and the accompanying drawings.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENTS

Figures 1, 1A, 1B:
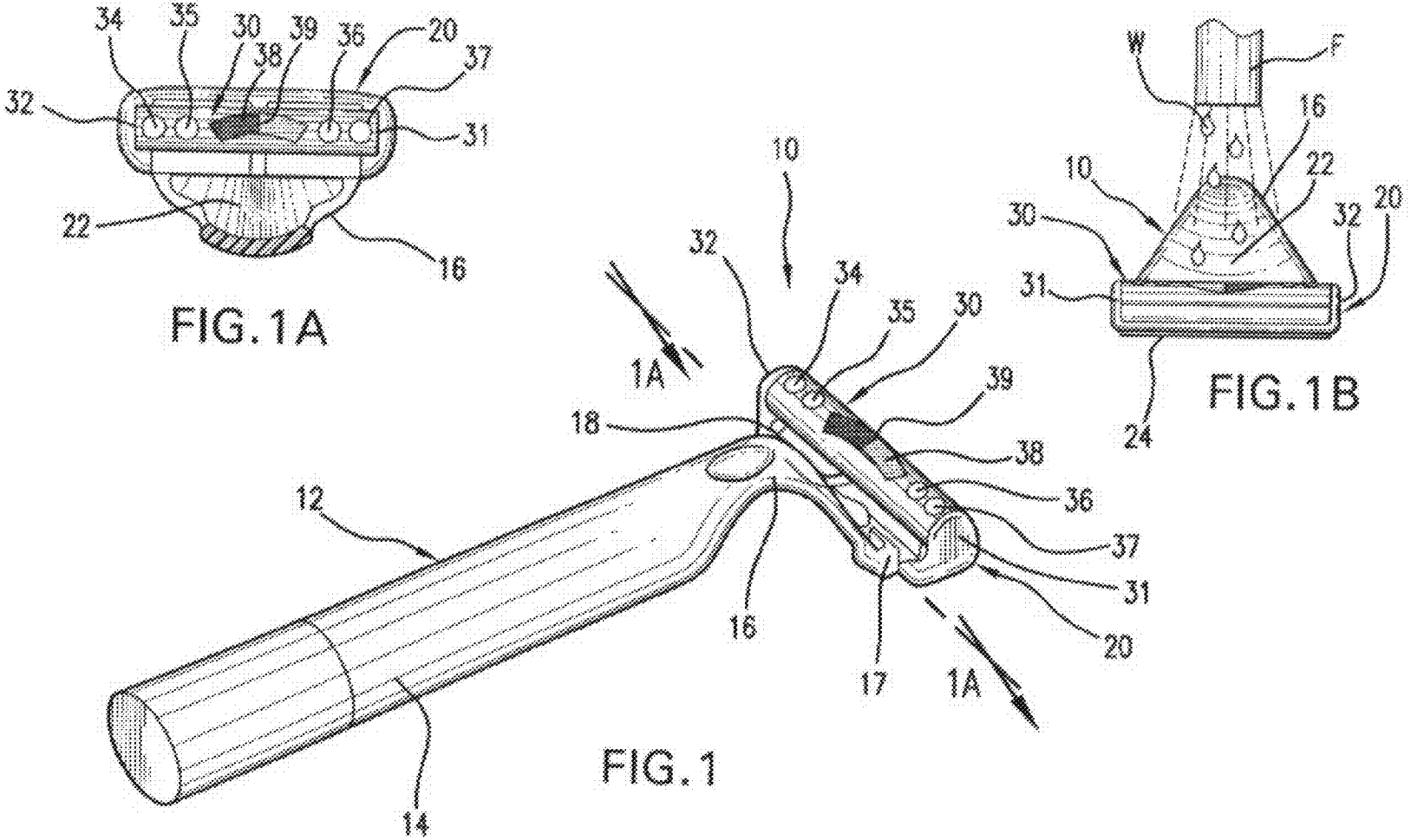
FIG. 1 is a top perspective view of the present invention including a disposable blade cartridge with an onboard blade heating system and a razor handle connected to the blade cartridge.
FIG. 1A is an isolated top plan view, taken along the plane of the line 1A-1A in FIG. 1, showing the blade cartridge with the onboard heating system and a concave scoop formation at the top end of the handle.
FIG. 1B is a front elevational view showing the blade cartridge of FIG. 1 with running water from a faucet being directed onto the concave scoop for flushing debris from the blades.
Figure 2:
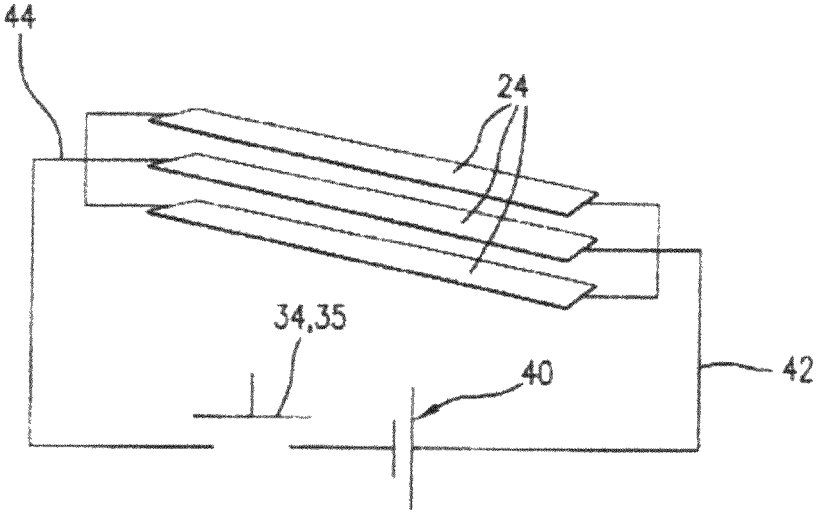
FIG. 2 is a general schematic diagram showing one embodiment wherein the blades of the razor are electrically connected in parallel.
Figure 3:
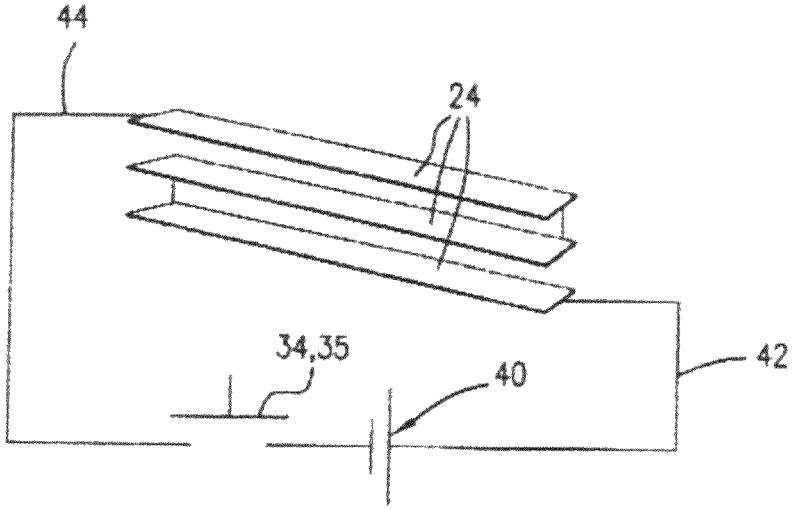
FIG. 3 is a general schematic diagram showing another embodiment wherein the blades are electrically connected in series.

Referring to FIGS. 1-1B, the razor with a blade heating system is shown and is generally indicated as 10. The razor 10 includes a handle 12 with an elongate grasping portion 14 and an integral neck 16. The neck is provided with connecting members 17, 18 on opposite sides for pivotal connection to a blade cartridge 20. The blade cartridge 20 may be affixed to the handle in a manner wherein the entire razor 10 is disposed of after several uses for shaving. Alternatively, the blade cartridge 20 may be removably attachable to the connecting members 17, 18 of the neck 16 wherein the blade cartridge is separated from the handle 12 and discarded after several uses when the blades begin to dull. Thereafter, a new blade cartridge 20 can be attached to the handle 12.

The handle 12 may contain a pressurized charge of shave cream or gel for dispensing in a manner similar to that disclosed in U.S. Pat. No. 5,070,611 to Derin et al. Alternatively, the handle 12 may be of any conventional type that is well known in the razor industry or a newly designed handle, such as an ergonomically shaped handle that may contain shave cream or gel for dispensing therefrom.

In a preferred embodiment, the handle 12 of the razor 10 in the embodiment of FIGS. 1-1B is specifically designed to include a concave top surface 22 on the neck portion extending towards the blade cartridge 20. This concave top surface 22, defining a scoop or channel, is specifically structured and configured for directing a stream of water flow through the blade cartridge 20, below a battery housing, and between the blades 24, to thereby rinse debris (e.g., cut hairs, shaving cream, skin particles, etc.) from the blade surfaces. As seen in FIG. 1B, rinsing of the blades 24 can be achieved by holding the blade cartridge 20 and, more particularly, the concave top surface 22 of the neck below a running stream of water W from a faucet F. The stream of water W from the faucet F strikes the concave top surface 22 and flows, in a highly directional stream, through the blade cartridge 20 and between the blades 24.

The onboard heating system is contained within a water-tight housing 30 on the blade cartridge 20, defining a bridge structure extending over the blades 24. As seen in FIGS. 1-1B, the water-tight housing 30 includes a transverse structure, extending substantially across the length of the blade cartridge, from a right end to a left end. The transverse structure may be cylindrical, as shown, and is integrally molded or attached to opposite end walls 31, 32, at the right and left ends of the blade cartridge 20. The transverse water-tight housing structure 30 contains a battery power source for providing electric current flow through the circuit of the blade heating system, and particularly through the blades 24 in the blade cartridge. In the preferred embodiment, controls are provided on the water-tight housing 30 and include an ON switch 34, and OFF switch 35, and temperature control switches. The temperature control switches include an increase temperature switch 36 and a decrease temperature switch 37 for adjusting the heated temperature of the blades. A temperature indicator 38 on the housing displays the adjusted temperature level of the heated blades. In a preferred embodiment, the temperature indicator 38 is a temperature sensitive multi-color display that is reactive to heat generated as a result of the resistance of current flow through the circuit, and particularly through the blades 24 in the blade cartridge 20. As seen in FIG. 1, the indicated temperature is determined by a border 39 between a darker area of the display and the lighter color area of the display. This border 39 or transition between the dark area and light area on the display moves from left to right as the temperature of the blades increases. More specifically, warm temperatures are indicated when the border 39 on the multi-color display is towards the left side, while hotter temperatures are indicated as the border 39 moves towards and across the right side of the display, with the hottest temperature being at the point where the border 39 reaches the far right side of the display. Electric current flow through the blades 24 is achieved by electrical conductors 42, 44 connecting at opposite ends of the blades and to the positive and negative terminals of the battery source 40 (see FIGS. 2 and 3) contained within the water-tight housing 30. The conductors 42, 44 may be connected to the blades 24 in parallel or series. Examples of the parallel and series blade connections in the circuit are shown in FIGS. 2-7C, as described in more detail hereinafter. The blade heating system circuit may further be provided with a timer or other device (e.g., a tilt switch) for opening the circuit, thereby deactivating (i.e., turning off) the blade heating system, in the event the user forgets to turn the blade heating system off by pressing the OFF switch 35 on the water-tight housing. In this instance, the circuit will be opened, thereby turning off the blade heating system, after a predetermined period of time has lapsed or by some other action (e.g., a tilt switch) that is normally performed when a user has completed the shaving process.

Figure 4:
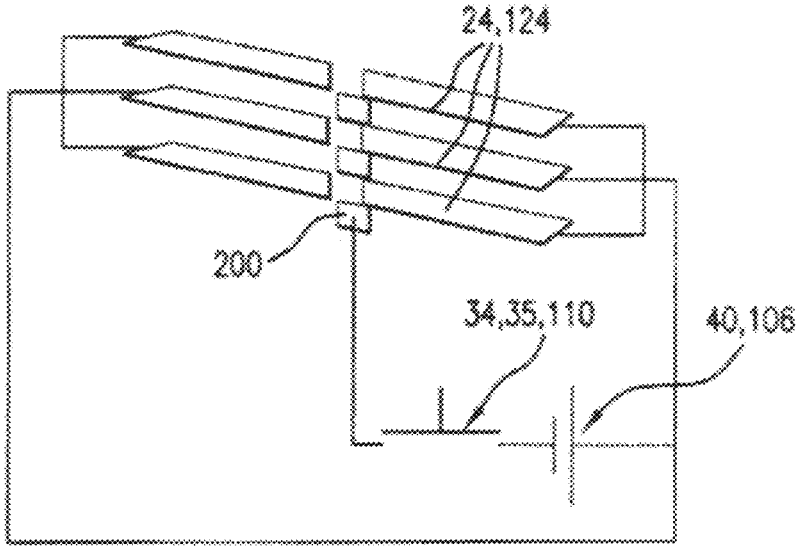
FIG. 4 is a general schematic diagram showing the electrical connection of the blades in parallel with a center tap connection.
Figure 5:
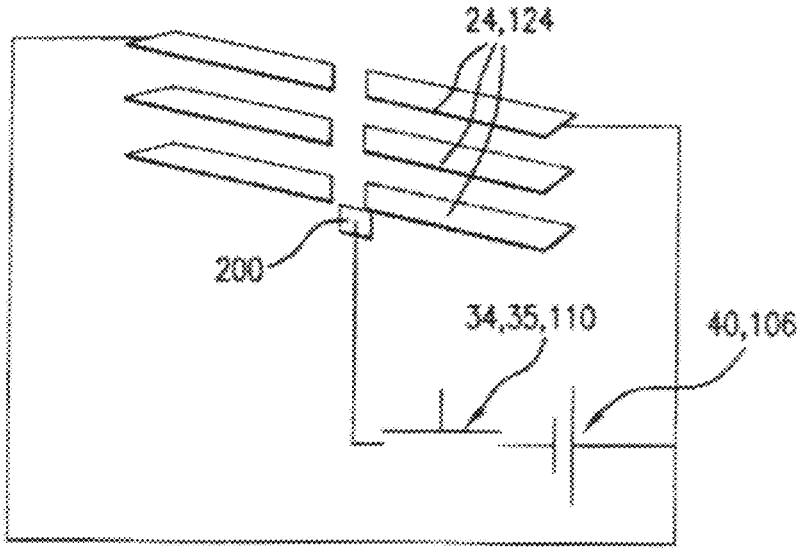
FIG. 5 is a general schematic diagram showing the electrical connection of the blades in series with a center tap connection.

FIGS. 4 and 5 illustrate a further embodiment of the electrical connection of the blades (24, 124) in the blade cartridge through a center tap connection 200. Specifically, FIG. 4 shows three blades in the blade cartridge connected in parallel through a center tap connection 200. FIG. 5 shows the three blades in the blade cartridge connected in series through a center tap connection 200. Use of a center tap connection 200 may be beneficial to provide consistent heat levels across the entire length of the blades.

Figure 6A:
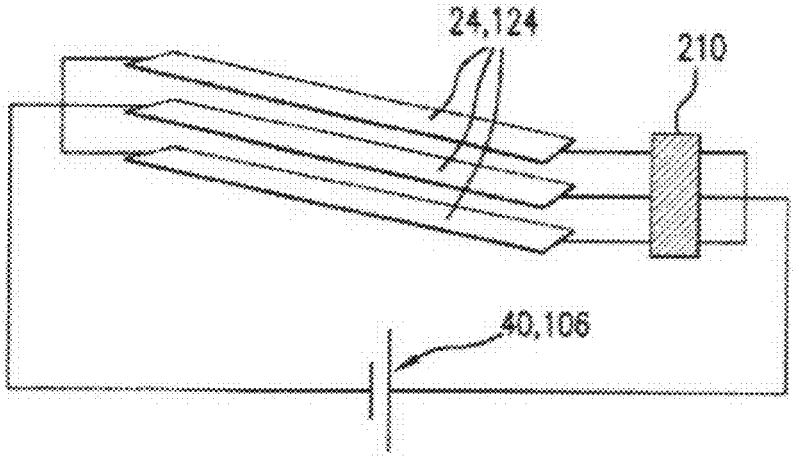
FIGS. 6A-6C illustrate a sequence of operation of a slide switch to control current flow through the blades connected in parallel in accordance with one embodiment of the heat controller.
Figure 6B:
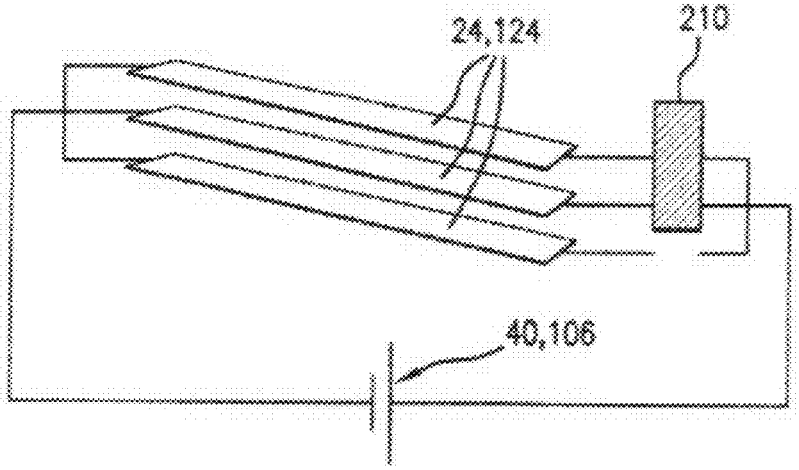
Figure 6C:
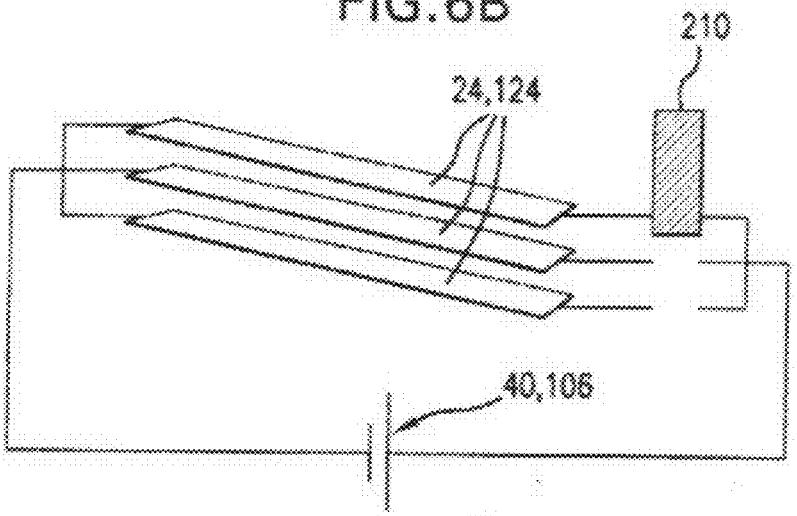

FIGS. 6A-6C illustrate an example of a slide switch control 210 for adjustably controlling the temperature level of the blades (24, 124), wherein the blades (24, 124) in the blade cartridge (20, 120) are connected in parallel. In this example, FIG. 6A shows the slide switch 210 completely closing the parallel connection of the three blades so that current flow is directed through all three of the blades rendering the lowest resistance, thereby providing the hottest temperature levels. FIG. 6B slows the slide switch 210 moved to disconnect the lower blade from the circuit, so that current flow is only directed through the middle blade and the top blade rendering medium resistance. This produces a medium level of heat. FIG. 6C shows the slide switch 210 moved to a third position, wherein the middle blade and the bottom blade are disconnected from the circuit so that current flow is only directed through the top blade rendering the highest resistance, thereby producing a temperature level that is not as hot as achieved in the slide switch positions of FIGS. 6A and 6B.

Figure 7A:
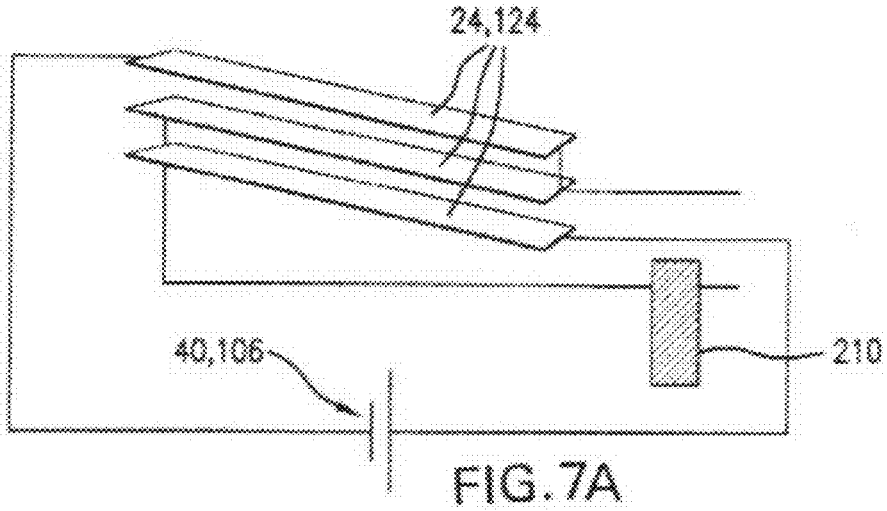
FIGS. 7A-7C illustrate a sequence of operation of a slide switch for controlling current flow through the blades connected in series in accordance with a further embodiment of the heat controller.
Figure 7B:
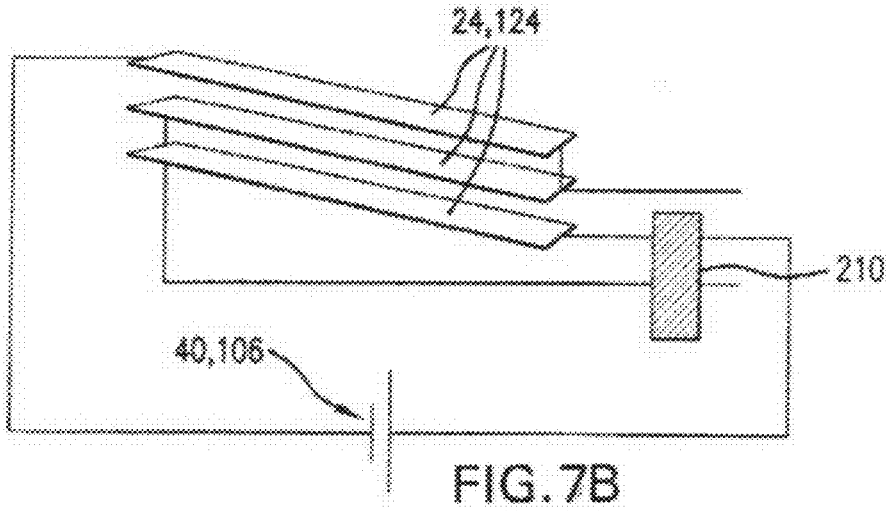
Figure 7C:
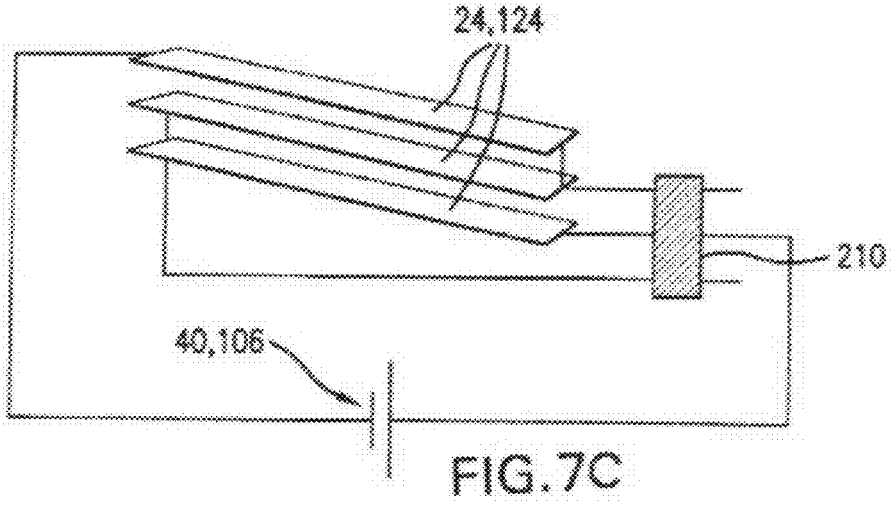

FIGS. 7A-7C illustrate a sequence of operation of a slide switch 210 to control blade temperature levels with the blades connected in series. In this example, FIG. 7A shows the slide switch 210 moved to the maximum resistance three blades in series low temperature position. In FIG. 7B, the slide switch 210 is moved to the medium resistance wherein two blades are connected in series to define a medium temperature position. FIG. 7C shows the slide switch moved to the minimum resistance wherein only one blade is in series to define the hottest temperature adjusted position.

Figure 8:
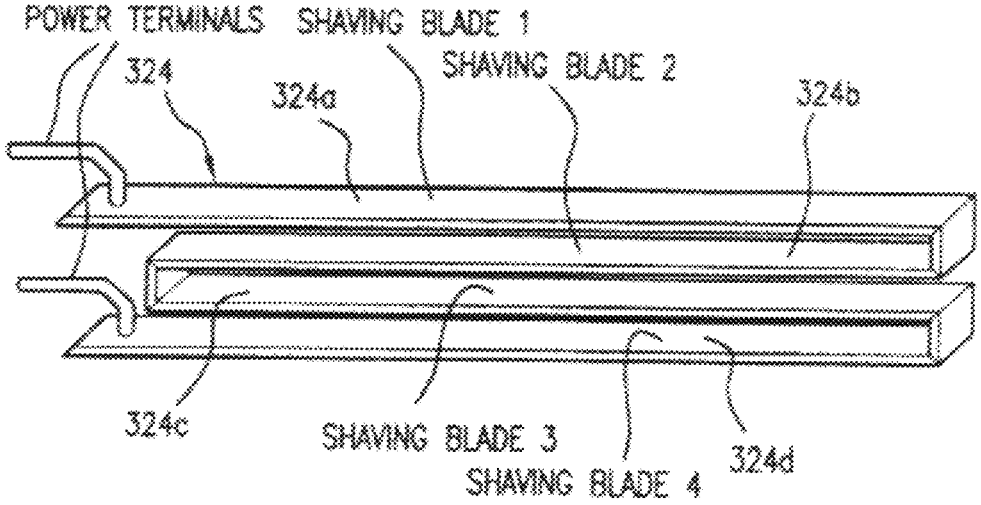
FIG. 8 is an isolated perspective view showing a further embodiment of the blade configuration comprising a continuous conductive razor blade folded into 4 parallel blades.

FIG. 8 shows a further embodiment of the blade configuration, wherein a continuous conductive blade 324 is folded into four parallel blades segments, 324*a*-324*d*. Each end of this continuous folded blade configuration is connected, via a conductor, to one of the terminals of the battery, to provide current flow through all four blade segments.

A slide switch, pressure actuated switch 34, 35 or a proximity switch may be may be used to open and close the circuit. More specifically, a proximity switch would allow the current flow to the blades upon contact of the blades with the user's skin. In this particular embodiment, the proximity switch acts as a capacitive and resistive sensing circuit that senses a difference in resistance or capacitance when the blades come in contact with the skin. Another embodiment may employ a contact switch or other type switch that closes when the blade cartridge pivots in response to pressure against the user's skin. The use of a proximity switch or other types of switches of this nature, in order to activate the blade heating system, serves as a highly effective means for preserving battery life. Other battery preserving measures include use of a timer, tilt switch or other device, as described above, for opening the circuit in the event the user fails to turn the blade heating system off after shaving.

While the present invention has been shown and described in accordance with several preferred and practical embodiments, it is recognized that departures from the instant disclosure are contemplated within the spirit and scope of the present invention which are not to be limited except as defined in the following claims as interpreted under the Doctrine of Equivalents.

What is claimed is:

1. A blade cartridge for a shaving razor having a handle, the blade cartridge comprising:

a plurality of electrically conductive blades each formed as a unitary body and each being structured and disposed for receiving an electric current flow through said unitary body;

a housing on said blade cartridge and extending substantially across the length of the blade cartridge in spaced and separated relation to the plurality of electrically conductive blades, and said housing defining a bridge structure extending over the blades and spaced from the blades to define an open gap between said housing and the plurality of electrically conductive blades for allowing a directed stream of water flow to pass below said housing, through the gap and between the plurality of electrically conductive blades for rinsing debris from surfaces of the plurality of electrically conductive blades;

an electric power storage source contained within said housing;

electric conductors connecting said electric power storage source to at least one of the plurality of electrically conductive blades for delivering electric current to the at least one of the plurality of electrically conductive blades, wherein flow of the electric current through the unitary body of the at least one of the plurality of electrically conductive blades causes the at least one of the plurality of electrically conductive blades to be heated; and a switch on said blade cartridge selectively operable between an ON status for allowing the electric current flow through the at least one of the plurality of electrically conductive blades, and an OFF status for interrupting the electric current flow through the at least one of the plurality of electrically conductive blades.

2. The blade cartridge as recited in claim 1 wherein the electric conductors are connected to direct the electric current flow through each of the plurality of electrically conductive blades.

3. The blade cartridge as recited in claim 1 further comprising:

a temperature indicator on said blade cartridge for indicating the heated temperature of the at least one of the plurality of electrically conductive blades.

4. The blade cartridge as recited in claim 1 further comprising:

a timer on the blade cartridge for interrupting the electric current flow through the at least one of the plurality of electrically conductive blades after a predetermined amount of time has lapsed.

* * * * *